United States Patent [19]

Bouchard et al.

[11] 4,315,733

[45] Feb. 16, 1982

[54] PHOTOFLASH LAMP WITH LOOSE POWDER COMPOSITION AND METHOD OF MAKING

[75] Inventors: Andre C. Bouchard, Peabody; George J. English, Reading, both of Mass.

[73] Assignee: GTE Products Corporation, Stamford, Conn.

[21] Appl. No.: 96,605

[22] Filed: Nov. 21, 1979

[51] Int. Cl.[3] ..... F21K 5/02

[52] U.S. Cl. ..... 431/362

[58] Field of Search ..... 431/358, 361, 362, 365

[56] References Cited

U.S. PATENT DOCUMENTS

| | | | |
|---|---|---|---|
| 2,305,561 | 12/1942 | Sylvesler | 431/362 |
| 2,791,111 | 5/1957 | Gleim | 431/362 |
| 2,798,368 | 7/1957 | Anderson | 431/362 |
| 3,220,224 | 11/1965 | Baird | 431/362 |
| 3,228,216 | 1/1966 | DeSaulniers et al. | 431/362 |
| 3,303,674 | 2/1967 | Anderson | 431/362 |
| 3,310,968 | 3/1967 | Buzalski | 431/362 |
| 3,332,257 | 7/1967 | Garner et al. | 431/362 |
| 3,535,063 | 10/1970 | Anderson et al. | 431/361 |

*Primary Examiner*—Samuel Scott
*Assistant Examiner*—Lee E. Barrett
*Attorney, Agent, or Firm*—Lawrence R. Fraley

[57] ABSTRACT

A photoflash lamp which includes a plastic envelope having a flash-producing composition therein. The composition, in loose powder form, is held in position within the envelope prior to ignition by a removable retention means (e.g., cup-shaped paper wad or mica disk). The wad or disk is removed (e.g., ruptured) during the early stages of the flash cycle. A method of making the lamp is also disclosed.

15 Claims, 4 Drawing Figures

PHOTOFLASH LAMP WITH LOOSE POWDER COMPOSITION AND METHOD OF MAKING

TECHNICAL FIELD

The invention relates to photoflash lamps and particularly to photoflash lamps which are electrically activated. Even more particularly, the invention relates to lamps of the above variety which utilize a flash-producing composition including a powdered metal and oxidizer wherein the composition is in loose powder form in the finished product.

BACKGROUND

In a copending application Ser. No. 096,606 (filed Nov. 21, 1979; Inventor, A. C. Bouchard), there is described a new and unique photoflash lamp which includes a loose powder, flash-producing composition therein. As described therein, the composition includes a powdered metal and powdered oxidizer in combined form. A preferred powdered metal is zirconium (having a particle size ranging from about 10 to 150 microns) and the preferred oxidizer may be potassium chlorate, potassium perchlorate, or sodium chlorate (with a particle size ranging, e.g., from about 10 to 150 microns). The composition, when ignited, produces a flash of light of sufficient intensity to meet the illumination requirements of today's higher speed films, e.g., ASA 400. One particular advantage of the above lamp is its relatively small size. In Ser. No. 096,606, the lamp possesses an internal volume of approximately 1.0 cubic centimeter or less. The lamp thus readily lends itself to miniaturization, a feature highly desired in the photoflash industry.

Utilization of a flash-producing composition in loose powder form in a photoflash lamp such as the one disclosed in Ser. No. 096,606 has proven advantageous for the following reasons: (1) loose powder compositions require less activation energy for ignition in comparison to similar compositions in a compressed or lacquer-bound (binder) orientation within the envelope; (2) the combustion rate for loose powder composition is faster due to enhanced oxygen diffusion into the fuel matrix; and (3) the inflammation period, that being the time required to transfer energy from the ignition primer mass (if employed) to the composition, is less when using a loose powder composition due to the greater porosity thereof. In addition to the above, use of a binder as an integral part of the composition may prove disadvantageous because typical binder materials emit gaseous products during the lamp's ignition cycle which in turn can attenuate light output and adversely affect envelope containment.

It can be understood from the foregoing that localization of the flash-producing composition within the lamp's envelope is critical to the successful operation of the lamp. Heretofore, localization was accomplished by using the aforedefined binder material, e.g., nitrocellulose, polyvinyl alcohol, etc., which functioned as an adhesive to secure the composition where desired. Unfortunately, however, these materials caused the problems described above (light attenuation, poor containment) when the composition was ignited.

It is believed, therefore, that a photoflash lamp which utilizes a loose powder, flash-producing composition and which provides for positive localization of the composition without the need for a binder or similar materials would constitute a significant advancement in the art.

DISCLOSURE OF THE INVENTION

It is a primary object of this invention to enhance the photoflash lamp art by providing a lamp which employs a means for assuring retention of the lamp's loose powder flash-producing composition at a designated location in the lamp's envelope without the need for binders and similar materials which can adversely affect the operational characteristics of the lamp.

It is another object of the invention to provide a new and unique method of making the above lamp.

These and other objects are accomplished in one aspect of the invention by the provision of a photoflash lamp which includes a light-transmitting envelope, a flash-producing composition positioned at a predetermined location within the envelope, ignition means for igniting the composition, and means for retaining the composition at the predetermined location and for being removed during ignition of the composition.

In accordance with another aspect of the invention, there is provided a method of making a photoflash lamp which comprises: (1) providing a tubular, light-transmitting member with opposing, open ends; (2) positioning a pair of conductive lead-in wires in one of the ends and sealing said end thereabout; (3) locating a quantity of loose-powder, flash-producing composition in the tubular member through the remaining, open end; (4) positioning a retaining means within the tubular member through the second open end in order that the retaining means can retain the flash-producing composition at a predetermined location in the tubular member; and (5) sealing the remaining open end to define a light-transmitting envelope.

BEST MODE FOR CARRYING OUT THE INVENTION

For a better understanding of the present invention together with other and further objects, advantages and capabilities thereof, reference is made to the following disclosure and appended claims in connection with the above-described drawings.

Figure 1:
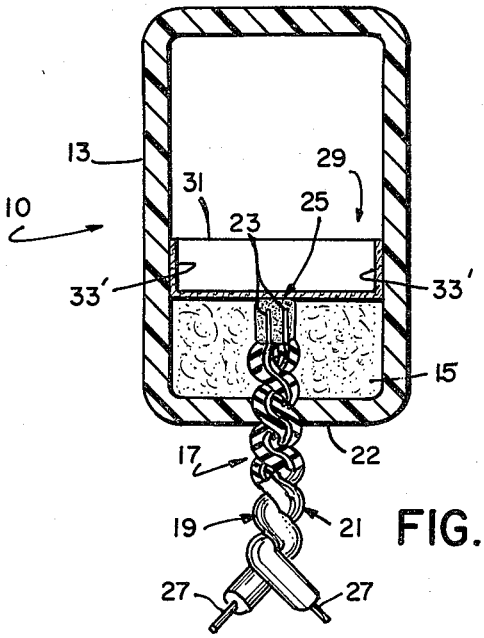
FIG. 1 is an elevational view, in section, of a photoflash lamp in accordance with a preferred embodiment of the invention.
Figure 4:
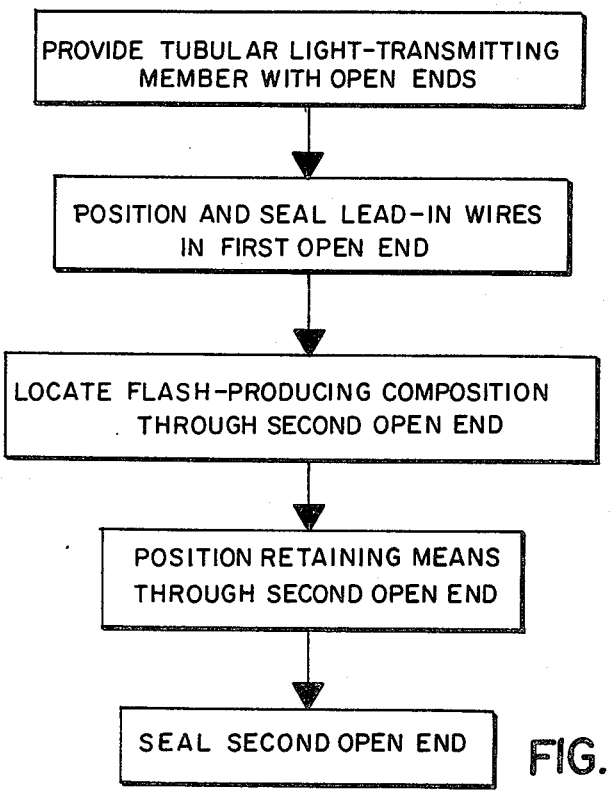
FIG. 4 is a flow diagram of the steps of producing a photoflash lamp in accordance with the teachings of the invention.

With particular reference to FIG. 1, a photoflash lamp 10 is shown as including a light-transmitting envelope 13, a flash-producing composition 15 within envelope 13 for providing the light output for lamp 10 upon ignition thereof, and ignition means 17 for igniting composition 15 to provide said output. Envelope 13, preferably cylindrical in shape, has an internal diameter of about 0.343 centimeter and an internal length of about 10.16 centimeter, giving the envelope an internal volume of approximately 1.0 cubic centimeter. Accordingly, lamp 10 is defined as being of the miniature variety (internal volume equal to or less than 1.0 cubic centimeter). The wall thickness for envelope 13 is about 0.127 centimeter. The preferred material for envelope 13 is plastic (e.g., polypropylene) which, having the above dimensions, results in the envelope being translucent. It is understood, of course, that other materials (e.g., glass) and dimensional variations are readily possible, including those which provide a transparent vessel.

Flash-producing composition 15 is in loose powder form (for the several advantageous reasons cited above) and comprises a predetermined quantity of a metal powder (serving as the fuel) and a predetermined quantity of oxidizer (serving as the oxygen supplier). The preferred powdered metal material is zirconium while the preferred oxidizer material is potassium chlorate. Other acceptable oxidizers include potassium perchlorate and sodium chlorate, while another acceptable powdered metal is hafnium. As described in Ser. No. 096,606, approximately 16 milligrams of zirconium powder and about 14 milligrams of potassium chlorate were used in several acceptable embodiments of composition 15. As also described in Ser. No. 096,606, the use of a relatively large particle size metal powder as a key ingredient in a powdered flash-producing composition represents a unique development in the photoflash lamp field. It was found that zirconium powders having particle sizes ranging from about 10 to about 150 microns could be successfully used to provide desired light outputs without sacrificing containment of the finished product's envelope. Improvements in color temperature were also possible, as well as the ability to readily adjust flash duration times. It was also found that large fuel particles, when combined with the aforedescribed oxidizers and positioned within the above envelope, burned at higher temperatures, emitted more light per unit weight, caused less pressure build-up, burned in a more localized manner, and were considerably less hazardous to handle, than similar mixtures containing fuels having "finely divided," e.g., 1.8 microns, particles. Obviously, the above features are deemed truly significant in the photoflash lamp field. It was also found that when using the above zirconium powder, the corresponding oxidizer should have a particle size within the range of about 10 to about 150 microns, although smaller size particles, e.g., 3 microns, can be used. Several successful combinations of the above materials are provided in Ser. No. 096,606.

The utilization of a plastic envelope 13 is possible when the above flash-producing composition 15 is employed due to the lack of need for a combustion-supporting atmosphere within the envelope. Accordingly, it is not necessary to hermetically seal envelope 13 as is required for lamps containing combustible foils and similar materials. For ease of manufacture, however, envelope 13 contains an atmosphere of air which in effect serves to support combustion. Permitting air to remain in the envelope during formation thereof eliminates the costly procedures of either extracting such atmosphere, e.g., to form a vacuum, or injecting same at high pressures, as typically required in known miniature lamps.

It was determined that the aforedescribed fuels, when used in plastic vessel lamps, should radiate at color temperatures of at least 4000 degrees K. The finished lamps of the instant invention were all capable of attaining these desired levels. It was also possible to obtain light outputs approaching 500 lumen seconds and, by varying the fuel-oxidizer ratios, to in turn vary the pulse (flash) duration of the output from about 2 to 60 milliseconds. Specifically, increasing the oxidizer content resulted in flash durations approaching the higher time values while excess fuel material produced short durations. Use of large particle fuels in an air-containing plastic envelope further permitted employment of large quantities of composition 15 in comparison to existing miniature lamps. For example, ratios greater than 7:1 (composition: internal volume) were possible with some exceeding 30:1.

Ignition means 17 is shown in FIG. 1 as including a pair of conductive lead-in wires 19 and 21 each having an 0.03 centimeter diameter copper wire covered by a 0.005 centimeter insulative coating. Wires 19 and 21 are twisted about each other (preferably about 4 turns per centimeter) into the configuration shown and sealed within a bottom (end) portion 22 of envelope 13. Understandably, it is also possible to secure these members within one of the envelope's sidewalls or within the opposing, upper end. Exposed ends 23 of wires 19 and 21 extend within envelope 13 approximately 0.318 centimeter and include thereon a quantity of primer material 25. As shown, ends 23 are spacedly oriented with portions of primer 25 located therebetween. Application of ignition voltage across the protruding ends 27 of wires 19 and 21 by a suitable power source, e.g., a piezoelectric element, typically associated with many of today's cameras results in generation of a spark across ends 23 and ignition of primer 25. A typical ignition voltage is about 3000 volts. The deflagrating primer 25 in turn ignites powdered composition 15. It is preferred that primer 25 be located within composition 15 or protrude slightly therefrom as illustrated in FIG. 1. It is possible to eliminate primer 25 in the present invention and directly ignited composition 15 using the spark generated between ends 23 of wires 19 and 21. In such an arrangement, ends 23 are defined as being in operative engagement with composition 15, e.g., by being inserted therein. One example of a primer material 25 successfully used in lamp 10 includes about 78 percent zirconium powder, 16 percent potassium perchlorate, 4 percent Alon C, and 2 percent nitrocellulose. Another suitable example included 50 percent zirconium, 30 percent potassium perchlorate, 10 percent tungstic oxide, 4 percent Alon C, 4 percent glass beads, and 2 percent nitrocellulose. All of the above percentages are by weight of the mixture. Methyl cellulose acetate was used as a solvent in preparation of both of the defined primers. Application of primer to the ends 23 of wires 19 and 21 was achieved by dipping these ends into the liquid suspension and withdrawing slowly (e.g., 0.635 centimeter per second). The coated ends were then sealed within the end of envelope 13 as illustrated. Approximately 1 milligram of primer 25 was used in lamp 10.

Although it has been shown and described to ignite composition 15 electrically, it is also within the scope of the invention to utilize percussively actuated means for this purpose. By way of example, a metal primer tube such as described in U.S. Pat. No. 3,535,063 (Anderson et al) could be employed and project from the bottom end of envelope 13. Deformation of the tube would result in deflagration of the fulminating material therein up through the tube and ignition of composition 15 located within the envelope 13 in a similar manner to that depicted in FIG. 1. The teachings of U.S. Pat. No. 3,535,063, are thus incorporated herein by reference.

As defined above, flash-producing composition 15 is in loose powder form within envelope 13. To assure that the composition is maintained at the desired, predetermined location shown (at or near lower end 22 of the envelope and about primer 25) prior to ignition thereof (e.g., during handling, shipping, etc.) lamp 10 further comprises means 29 for retaining the composition at this location. Composition 15 is preferably retained about the ignition means so as to assure rapid ignition and repeatable burning of the main fuel charge. This would not occur if the loose charge (composition) was indiscriminately scattered about the interior of envelope 13.

In accordance with the teachings of the invention, means 29 comprises a wad member 31 which frictionally engages the internal walls of envelope 13 with only sufficient frictional force so as to retain composition 15 prior to and during the initial stages of composition ignition. By the term wad is meant any member which will positively retain the loose powder composition in the desired localized position during the periods designated. Such a member needn't be solid and may in fact contain small apertures or pores therein. Wad 31 must only restrain composition 15 during the initial ignition stages but, due to gaseous expansion, must be removed, either through displacement or rupture, as ignition progresses. It is not necessary that wad 31 physically engage composition 15 (and therefore possibly exert force thereagainst) but only that it serve to define an upper boundary beyond which the composition may not pass (until latter ignition stages). In one example of the invention, wad 31 was located a distance of about 0.10 to about 0.12 centimeter above the composition.

Figure 3:
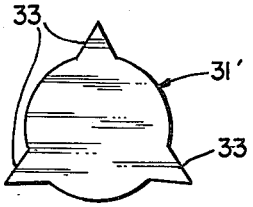
FIG. 3 is a plan view of the retention means of FIG. 2 prior to positioning within the invention.
Figure 2:
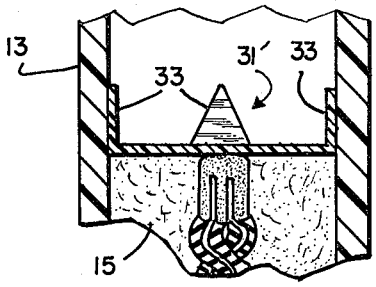
FIG. 2 is a partial elevational view, in section, of an alternate embodiment of a loose powder retention means for use in the lamp of FIG. 1.

Satisfactory materials for wad 31 include paper, nitrocellulose film, fiber glass, mica, aluminum, and zirconium, with preference toward paper and the nitrocellulose film. For lamps having an internal volume substantially less than 1.0 cubic centimeter, it is preferred to use the non-organic materials, e.g., aluminum, fiber glass, mica, zirconium, for wad 31 to substantially eliminate any possibility of envelope rupture. The wad may assume a cup-shaped configuration (as illustrated in FIG. 1) or it may comprise a cylindrical, thin disk 31' (as shown in FIGS. 2 and 3) having several, e.g., three, projecting tabs 33 which are bent up to provide frictional engagement with envelope 13. In both cases, the wad preferably has a thickness of from about 0.001 to about 0.010 centimeter. If cup-shaped, wad 31 preferably includes upstanding sides 33' (when viewed in cross-section) which provide this frictional engagement. It was determined, for example, that when using a paper wad possessing an overall external diameter of about 0.013 centimeter greater than the internal diameter of envelope 13, the wad was capable of providing the required, limited frictional force.

Tests of lamps utilizing the above wad members also indicated that light output and envelope containment were not significantly affected, and in some instances, light output remained the same.

The above lamps were each produced by initially providing a piece of elongated, polypropylene tubing having opposed (first and second) open ends and the described internal diameter (0.343 centimeter). The dual-wired electrical ignition means 17, with wires 19 and 21 twisted together and having primer 25 thereon, was inserted within a first open end of the tube and said end sealed. Sealing was achieved using a heated aluminum block having a recessed (concave) portion with an aperture centrally located therein and passing through the block. Wires 19 and 21 where oriented within the block's aperture to extend within the recessed portion whereupon the polypropylene tubing was lowered about the wiring until engagement was effected between the recess and the tube's first open end. A small force was then exerted at the opposing, second open end of the tubing such that the first end was pressed against the block and deformed about the contained wiring. The tubing, now having ignition means 17 secured therein, was removed from the aluminum block and oriented vertically. The described quantity of flash-producing composition 15 was then dropped (using a funnel) into the upright tubing through the second open end. The composition fell to the bottom (first end) to surround the extending ends of wires 19 and 21 in the manner shown in FIG. 1. Retention means 29 was then inserted into the tubular member through the second open end until the desired elevation above composition 15 was reached. The next step involved sealing the remaining (second) end to define a finished product. This process simply involved inserting the second end within the recess of the aforedescribed, heated aluminum block until closure was accomplished and a completed envelope was defined.

It is understood that the above process will result in the surrounding atmosphere present during the last sealing step to become confined within the envelope, unless preventive steps (e.g., vacuum drawing) are taken. In a typical working environment, this atmosphere will obviously comprise air, an atmosphere totally satisfactory for permitting combustion of the invention's flash-producing composition therein. This air will also be at normal atmospheric pressure when located therein and not at the much higher pressures typically required in known miniature lamps. Accordingly, the invention can be readily produced with less cost and difficulty than methods utilized in producing current miniature lamps which utilize combustible shred material. Furthermore, it is understood that envelope 13 needn't be completely (hermetically) sealed at either end as is required in the above, combustible-type lamps containing a pressurized, oxygen atmosphere therein.

While there have been shown and described what are at present considered the preferred embodiments of the invention, it will be obvious to those skilled in the art that various changes and modifications may be made therein without departing from the scope of the invention as defined by the appended claims.

We claim:

1. A miniature photoflash lamp comprising:

a light-transmitting envelope;

a flash-producing composition in loose powder form positioned at a predetermined location within said envelope in contact with the internal walls thereof for providing a substantially localized, highly intense flash of light upon ignition thereof, said flash-producing composition including a quantity of powdered oxidizer;

ignition means secured within a wall or end portion of said envelope for igniting said flash-producing composition; and means for retaining said flash-producing composition at said predetermined location within said envelope, said means located within said envelope and frictionally engaging the internal walls of said envelope with only the frictional force necessary to retain said composition at said location prior to ignition thereof and for being removed from said location during ignition of said composition.

2. The photoflash lamp according to claim 1 wherein the material of said envelope is selected from the group consisting of plastic and glass.

3. The photoflash lamp according to claim 2 wherein said plastic is polypropylene.

4. The photoflash lamp according to claim 1 wherein said powdered metal is selected from the group consisting of zirconium and hafnium and said powdered oxidizer is selected from the group consisting of potassium chlorate, potassium perchlorate and sodium chlorate.

5. The photoflash lamp according to claim 1 wherein said ignition means includes a pair of lead-in wires having an insulative coating on at least a portion thereof, each of said lead-in wires having an exposed, conductive end portion extending within said envelope.

6. The photoflash lamp according to claim 5 wherein said lead-in wires are twisted about each other within said wall or end portion of said envelope.

7. The photoflash lamp according to claim 5 further including a quantity of primer material positioned on said exposed, conductive end portions of said lead-in wires for igniting said flash-producing composition upon ignition thereof, said primer material located within said composition or protruding slightly therefrom.

8. The photoflash lamp according to claim 1 wherein said means for retaining said flash-producing composition comprises a wad member located in contact with or immediately above said composition.

9. The photoflash lamp according to claim 8 wherein the material for said wad member is selected from the group consisting of paper, nitrocellulose, fiber glass, mica, aluminum, and zirconium.

10. The photoflash lamp according to claim 8 wherein said wad member is of cup-shaped configuration having upstanding sides, said upstanding sides frictionally engaging the internal walls of said envelope.

11. The photoflash lamp according to claim 8 wherein said wad member comprises a thin, disk member.

12. The photoflash lamp according to claim 11 wherein said disk member includes a plurality of projecting tabs, said projecting tabs frictionally engaging the internal walls of said envelope.

13. A method of making a miniature photoflash lamp, said method comprising:

providing a tubular, light-transmitting member having first and second opposing open ends;

positioning a pair of conductive lead-in wires within said first of said open ends and sealing said first open end with said wires therein such that an end portion of each of said wires extends within said tubular member;

positioning a quantity of loose powder, flash-producing composition within said tubular member through said open end whereby said composition will occupy a predetermined location within said envelope in contact with the internal walls thereof, said composition providing a substantially localized, highly intense flash of light upon ignition thereof;

positioning a retaining means within said tubular member through said second open end, said retaining means frictionally engaging the internal walls of said envelope with only the frictional force necessary to retain said composition at said predetermined location prior to ignition thereof and for being removed from said location during said ignition; and sealing said second open end of said tubular member to define a light-transmitting envelope.

14. The method according to claim 13 further including providing an insulative coating on at least a portion of said lead-in wires and twisting said wires about each other prior to sealing said wires within said first open end of said tubular member.

15. The method according to claim 13 further including providing a quantity of primer material on said extending ends of said lead-in wires prior to positioning said flash-producing composition within said tubular member, said primer material located within said flash-producing composition or protruding slightly therefrom after said composition has been positioned within said tubular member.

* * * * *